US009701382B2

(12) United States Patent
Lowe

(10) Patent No.: US 9,701,382 B2
(45) Date of Patent: Jul. 11, 2017

(54) SAIL ASSEMBLY USING SLUGS AND FLAKERS

(71) Applicant: Lawrence Lowe, West Des Moines, IA (US)

(72) Inventor: Lawrence Lowe, West Des Moines, IA (US)

( * ) Notice: Subject to any disclaimer, the term of this patent is extended or adjusted under 35 U.S.C. 154(b) by 0 days.

(21) Appl. No.: 15/147,457

(22) Filed: May 5, 2016

(65) Prior Publication Data

US 2016/0244137 A1 Aug. 25, 2016

Related U.S. Application Data

(63) Continuation-in-part of application No. 14/285,190, filed on May 22, 2014, now Pat. No. 9,352,815.

(60) Provisional application No. 61/827,957, filed on May 28, 2013.

(51) Int. Cl.
*B63H 9/04* (2006.01)
*B63H 9/08* (2006.01)

(52) U.S. Cl.
CPC ..... *B63H 9/08* (2013.01); *B63H 2009/086* (2013.01)

(58) Field of Classification Search
CPC ..... B63H 9/00; B63H 9/08; B63H 9/1092; B63H 2009/00; B63H 2009/08; B63H 2009/086
USPC ..... 114/102.1, 102.12, 102.15, 102.29, 104, 114/105, 106, 107, 108, 109, 113, 114, 114/115
See application file for complete search history.

(56) References Cited

U.S. PATENT DOCUMENTS 3,851,609 A * 12/1974 Stearn ..... B63H 9/1028 114/105
3,980,036 A * 9/1976 Crall ..... B63H 9/1028 114/106
4,343,257 A * 8/1982 Stevenson, IV ..... B63H 9/10 114/104
4,474,127 A * 10/1984 Stevenson, IV ..... B63H 9/1092 114/104
RE31,829 E * 2/1985 Stearn ..... B63H 9/1028 114/105
5,799,601 A * 9/1998 Peay ..... B63B 35/7973 114/102.27
2011/0308440 A1* 12/2011 Luque ..... B63H 9/08 114/102.15
2014/0352593 A1* 12/2014 Lowe ..... B63H 9/08 114/104

* cited by examiner

*Primary Examiner* — Daniel V Venne
(74) *Attorney, Agent, or Firm* — Zarley Law Firm, P.L.C.

(57) ABSTRACT

A sail assembly using slugs and flakers is presented. The sail slug has a plurality of rollers positioned along an inner edge that are received within a groove of a mast. The outer edge of the sail slug has a swivel platform that attaches to straps positioned on a sail. The flaker has a pair of leaves having a first end, a longitudinal section, and a second end with a bracket. The brackets of the leaves have openings that align to receive a torsion spring and an axle to hingedly connect the pair of leaves.

3 Claims, 12 Drawing Sheets

SAIL ASSEMBLY USING SLUGS AND FLAKERS

CROSS REFERENCE TO RELATED APPLICATION

This is a Continuation-in-part application of U.S. Ser. No. 14/285,190 filed May 22, 2014, now U.S. Pat. No. 9,352,815 issued May 31, 2016, which claims the benefit of U.S. Provisional Patent Application Ser. No. 61/827,957 filed May 28, 2013.

BACKGROUND OF THE INVENTION

This invention is directed to a sail assembly and more particularly to a sail assembly having improved slugs and flakers.

Sail assemblies are well-known in the art. Presently, conventional slugs are made in a cylindrical shape and are slightly smaller in diameter than the groove in the mast. While the ends are rounded, conventional slugs have a tendency to bind.

In addition, present flaking kits use a number of lines threaded through a vertical row of holes in the main sail and tied to a line running from the top of the mast and anchored to the boom at the bottom. These kits are complex and rely upon both gravity and effort by the sailor to flake the sail. Accordingly, a need exists in the art for an assembly that addresses these deficiencies.

SUMMARY OF THE INVENTION

A sail assembly using slugs and flakers is presented. The sail slug has a plurality of rollers positioned along an inner edge that are received within a groove of a mast. The outer edge of the sail slug has a swivel platform that attaches to straps positioned on a sail. The flaker has a pair of leaves having a first end, a longitudinal section, and a second end with a bracket. The brackets of the leaves have openings that align to receive a torsion spring and an axle to hingedly connect the pair of leaves.

DETAILED DESCRIPTION OF THE PREFERRED EMBODIMENTS

Figure 1:
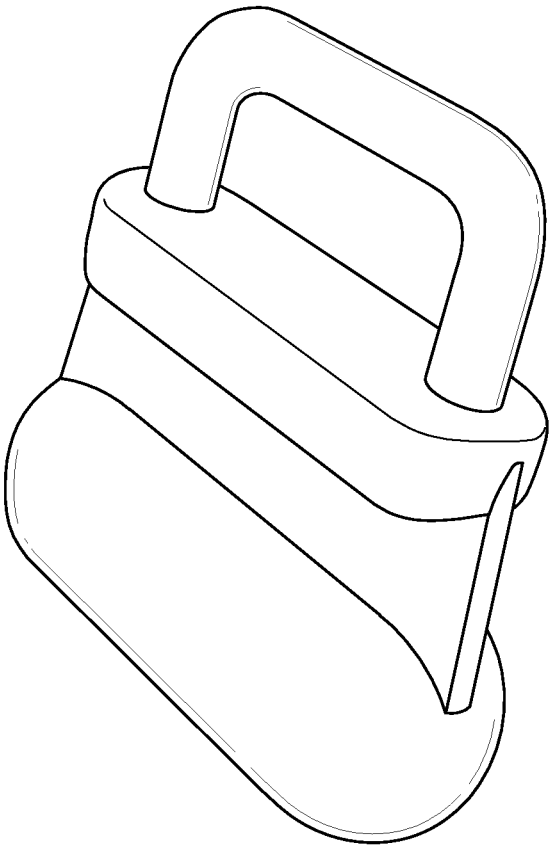
FIG. 1 (PRIOR ART)
FIG. 1 is a perspective view of a prior art sail slug.
Figure 2:
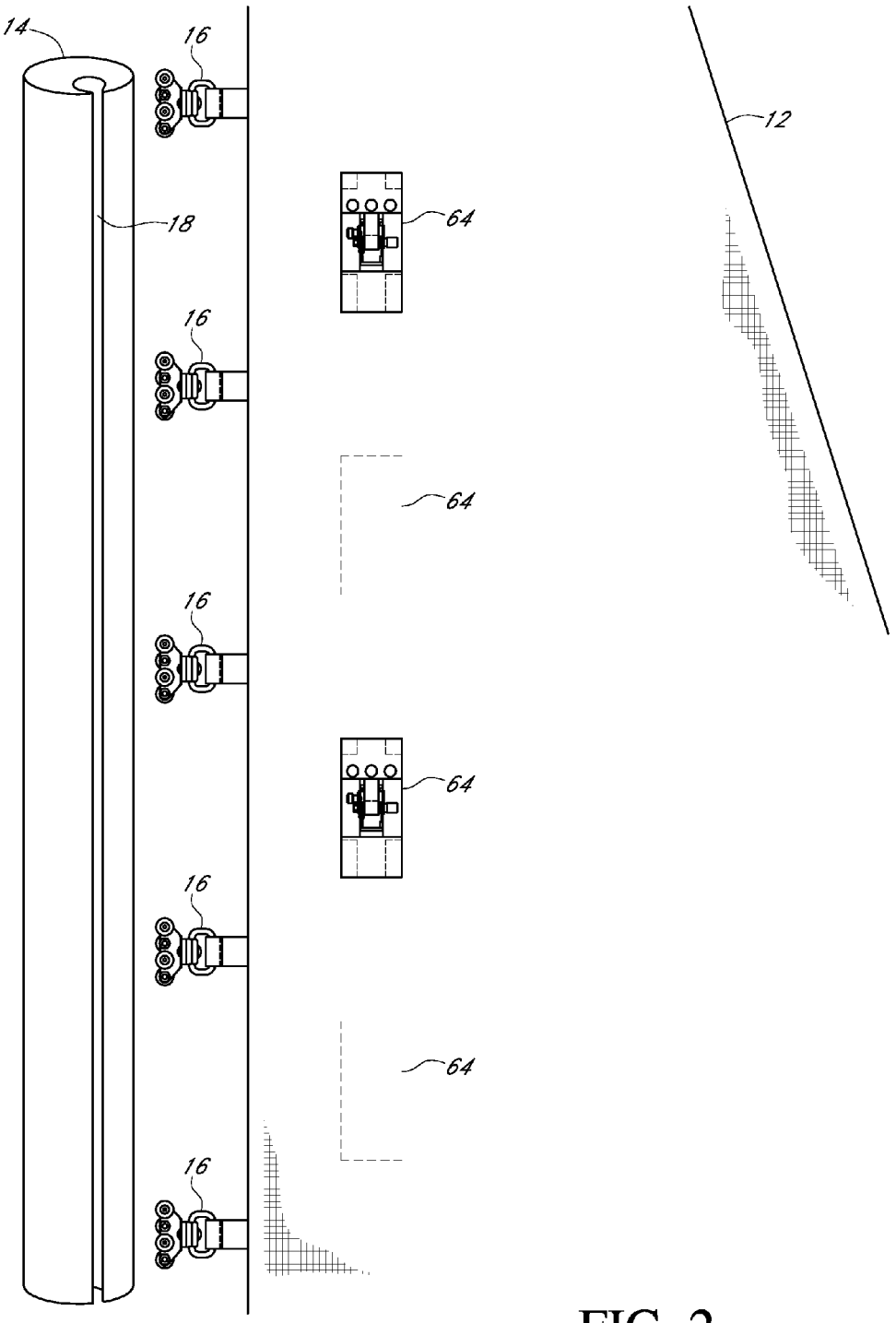
FIG. 2 is an exploded perspective view of a sail assembly using slugs and flakers.
Figure 3:
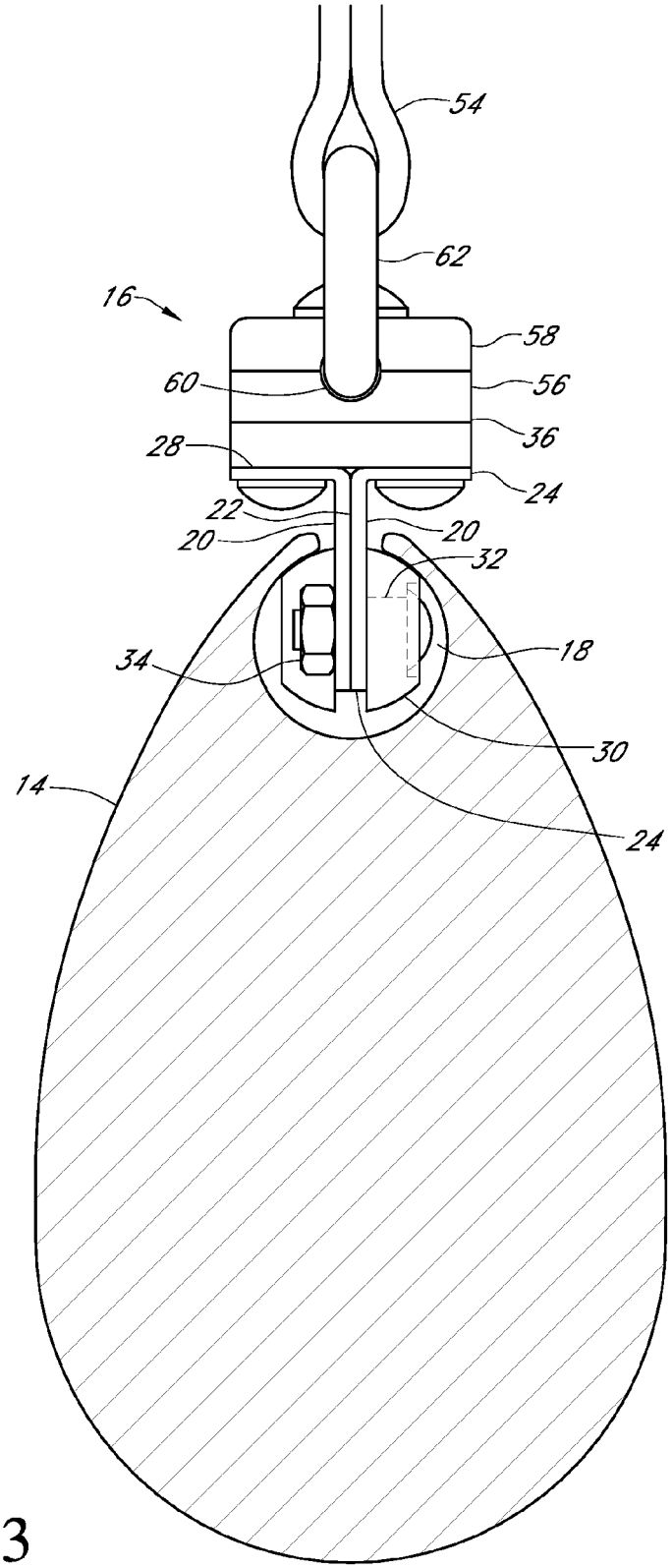
FIG. 3 is a top elevation cut-away view of a sail assembly using slugs and flakers.
Figure 4:
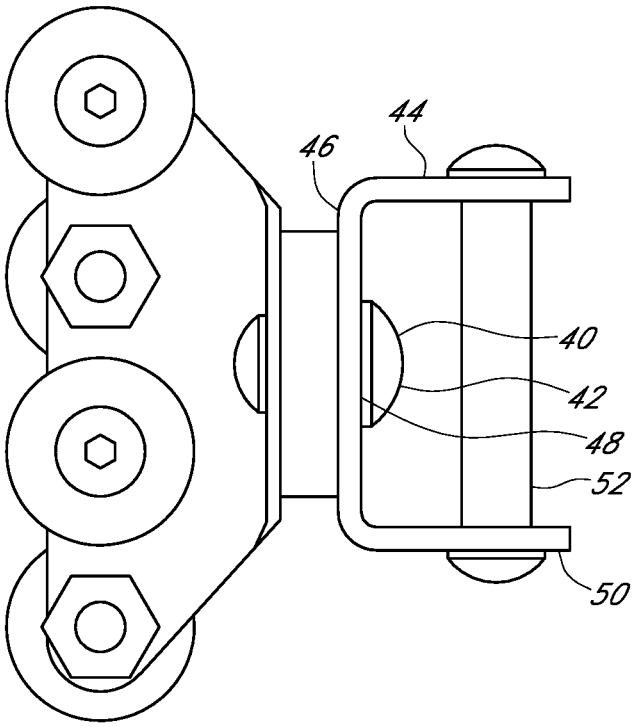
FIG. 4 is a perspective view of a sail slug.
Figure 5:
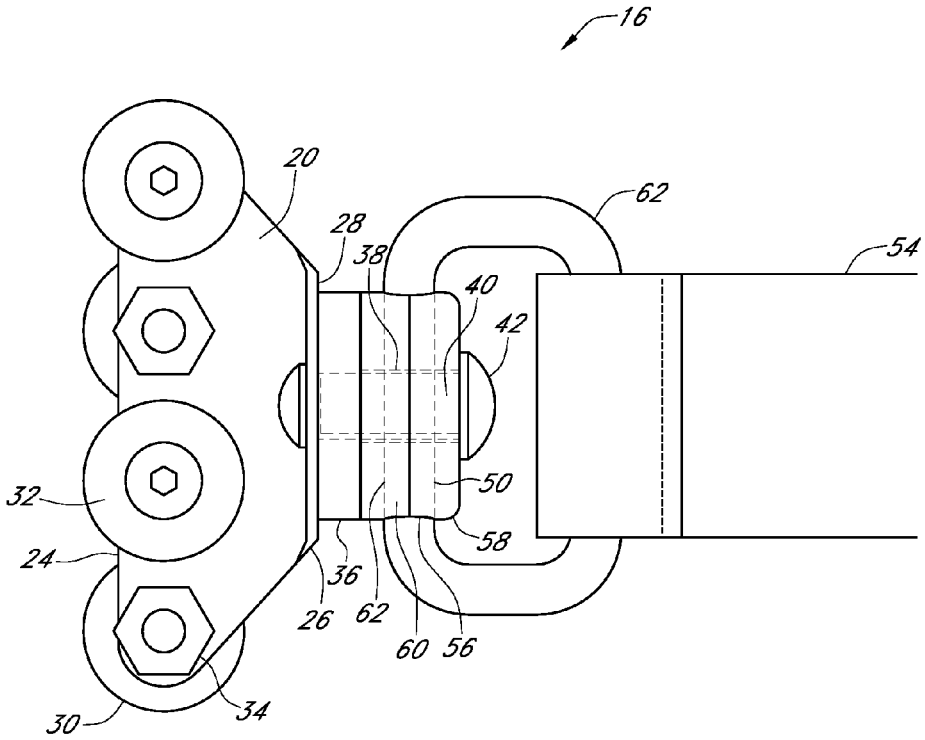
FIG. 5 is a side elevation view of a sail slug.
Figure 6:
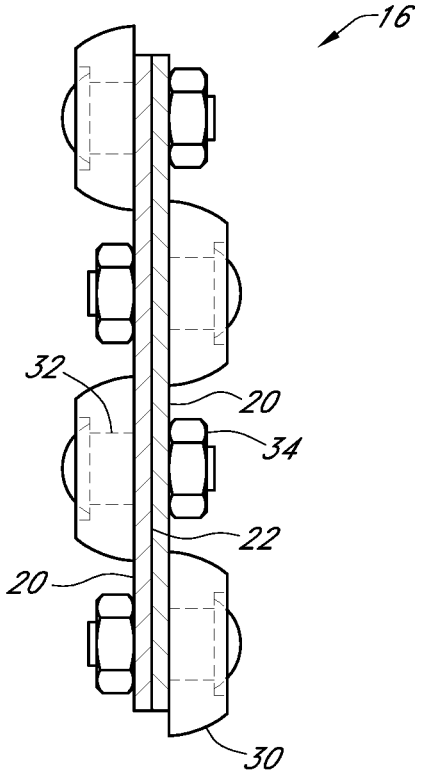
FIG. 6 is a bottom elevation view of a sail slug.
Figure 7:
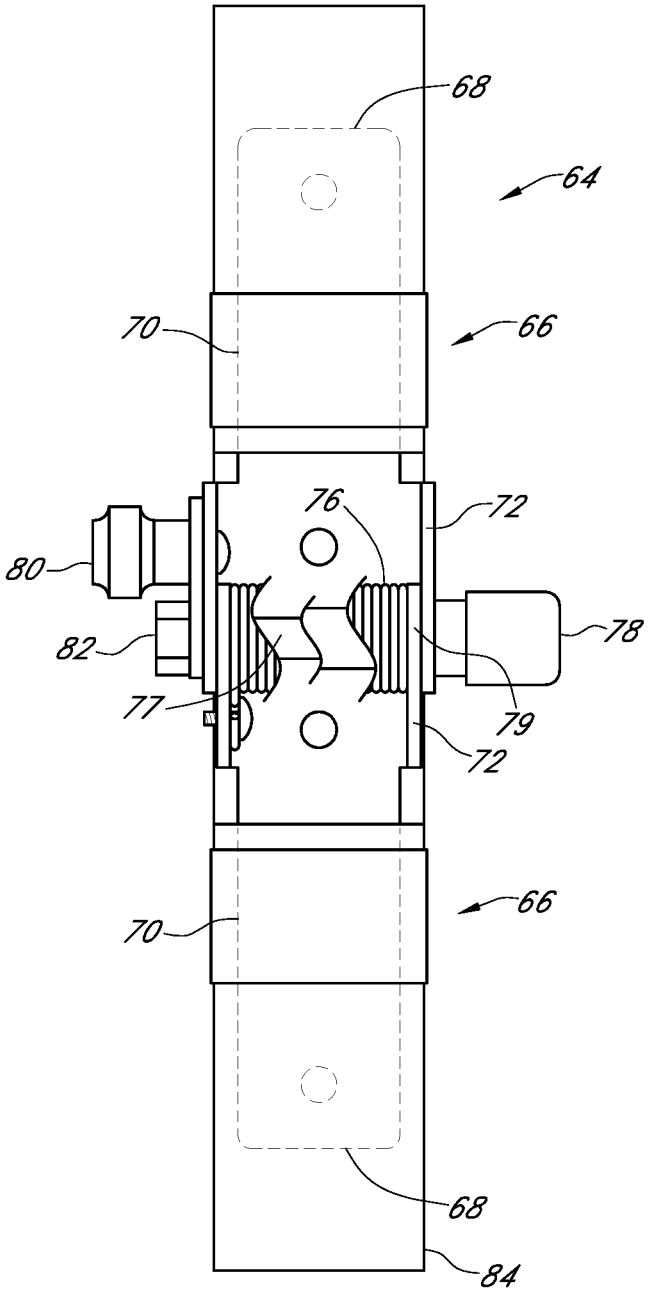
FIG. 7 is a top elevation view of a flaker.
Figure 8:
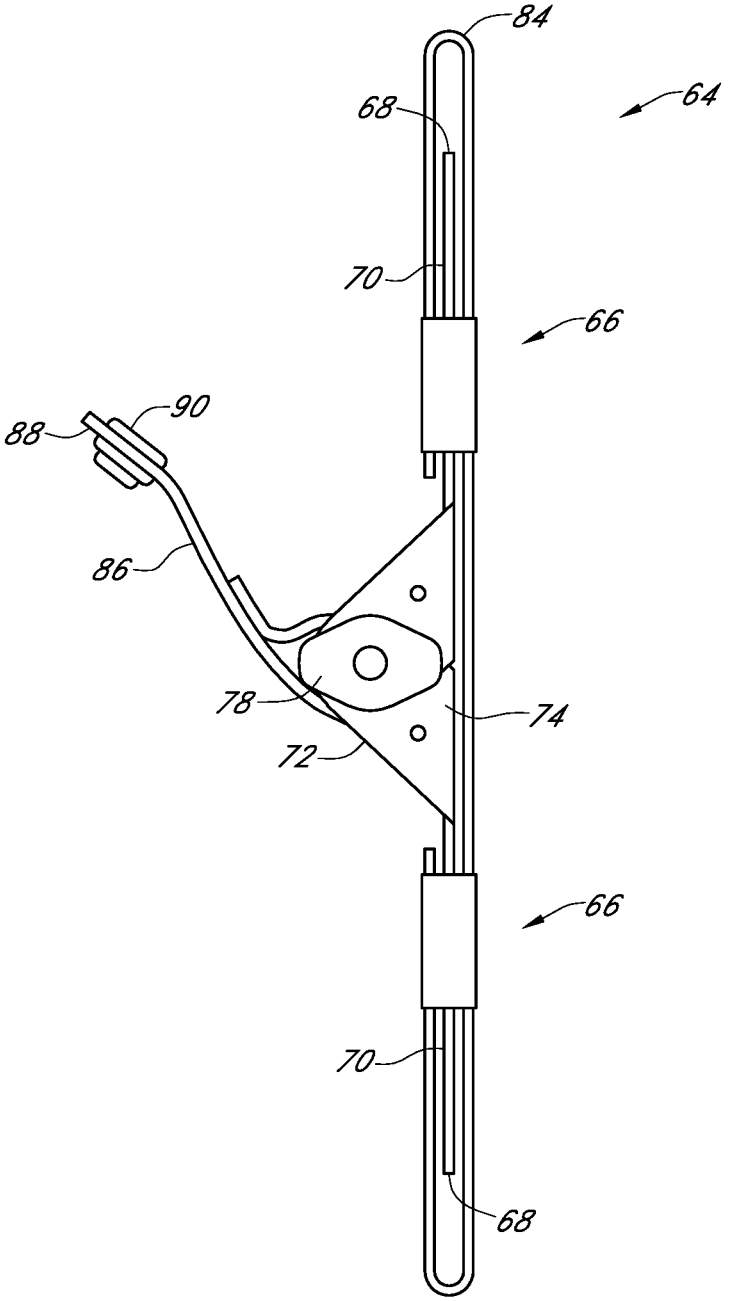
FIG. 8 is a right side elevation view of a flaker.
Figure 9:
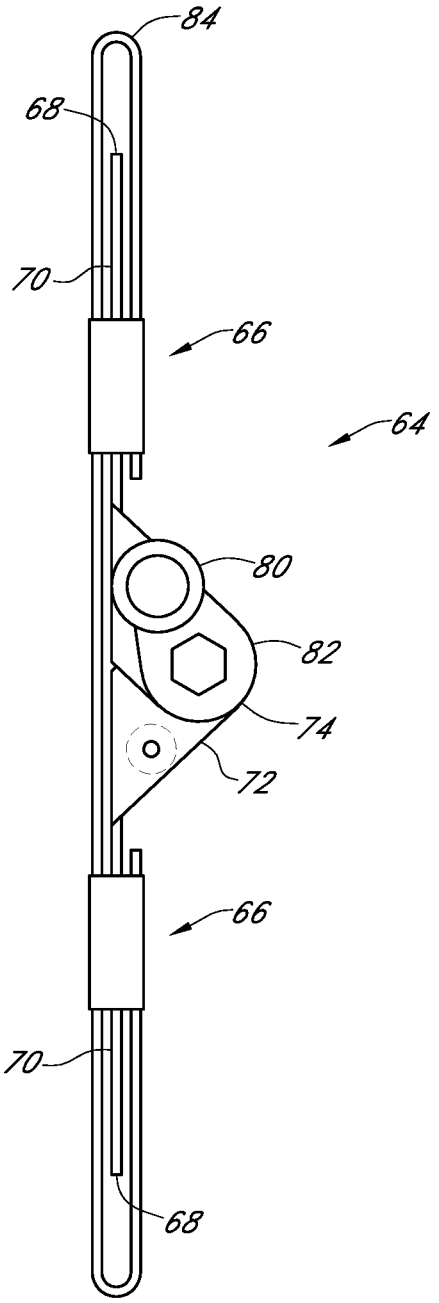
FIG. 9 is a left side elevation view of a flaker.
Figure 10:
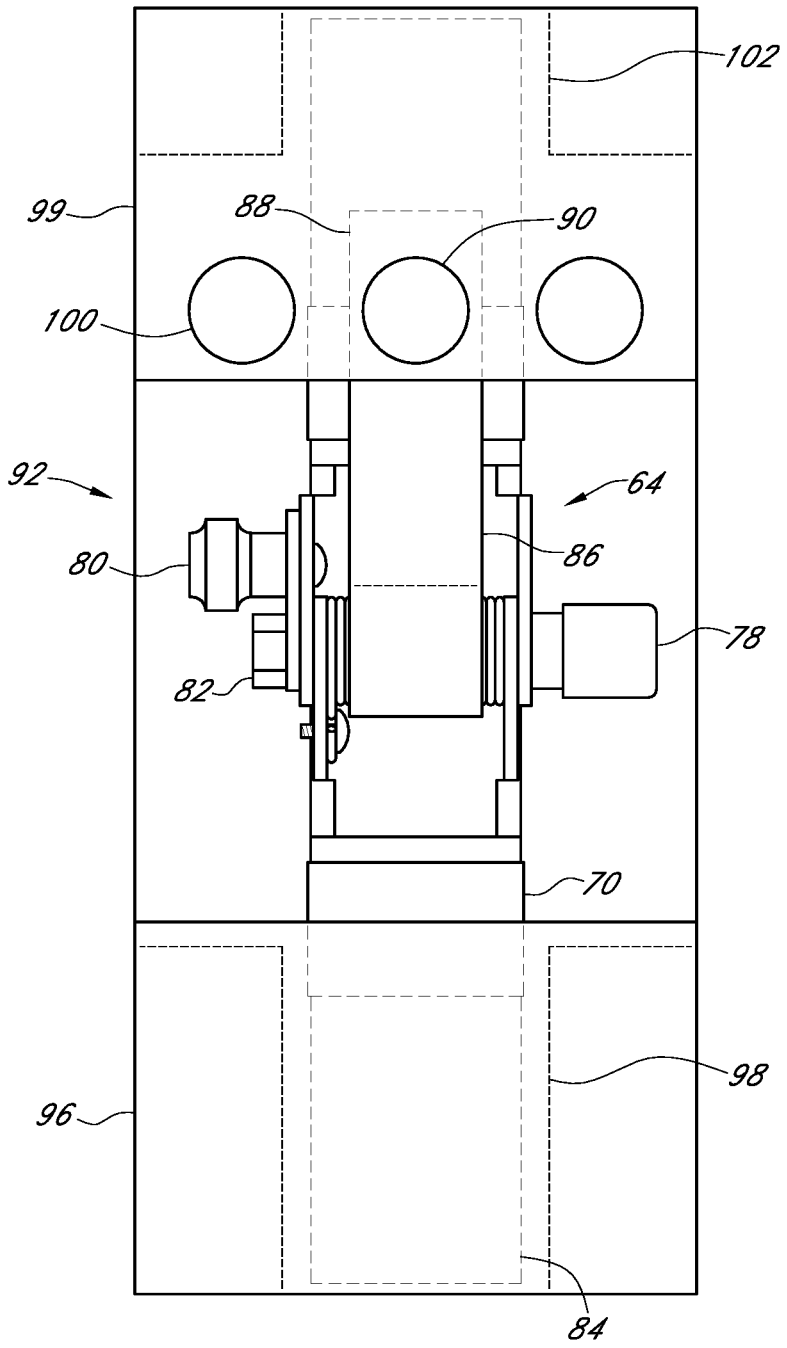
FIG. 10 is a top elevation view of a flaker.
Figure 11:
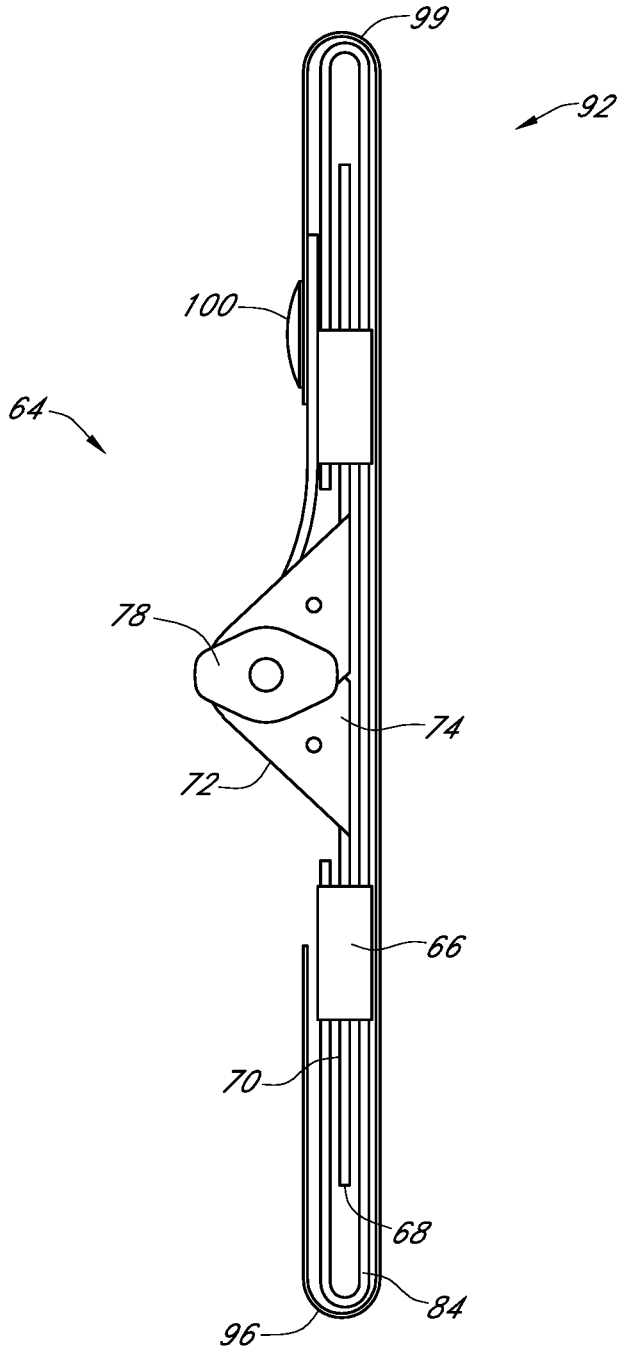
FIG. 11 is a right side elevation view of a flaker.
Figure 12:
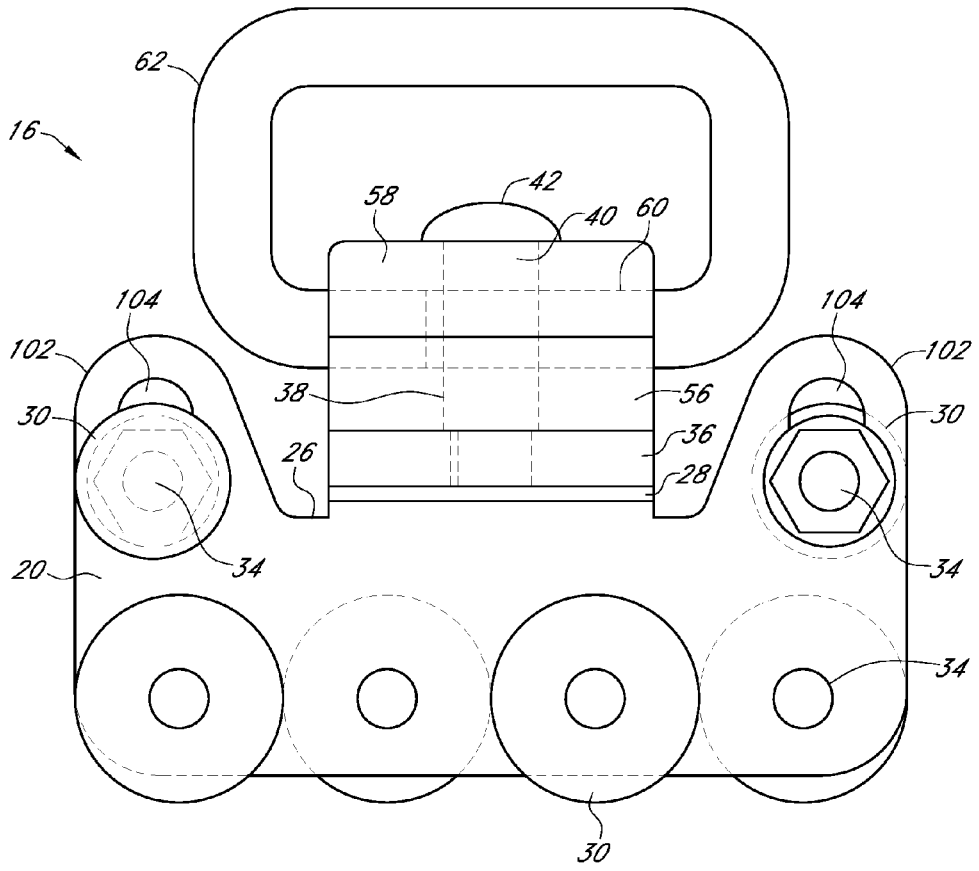
FIG. 12 is a side sectional view of a sail slug.

Referring to the Figures, a sail assembly 10 includes a main sail 12 attached to a mast 14 with a plurality of sail slugs 16 that fit within a groove 18 that extends longitudinally along the mast 14. The sail slugs 16 have a pair of mounting plates 20 that engage one another on an inner surface 22. The mounting plates 20 have a first or inner edge 24 and an outer edge 26 that extends outwardly to form a swivel platform 28. Preferably, the mounting plates 20 have a trapezoidal shape.

Rotatably mounted in-line along the inner edge 24, in an alternating arrangement, from one side to the other, are a plurality of half spheres 30 that serve as rollers. The spheres 30 are rotatably mounted about an axle 32 or screw that is secured on the opposite side of the mounting plates 20 by a hex nut 34 or the like.

Mounted to the swivel platform 28 is a swivel base 36. The swivel base 36 has a central opening 38 that threadably receives a shoulder screw 40. Rotatably mounted to the shoulder screw 40 between a head 42 of the screw 40 and the swivel base 36 is a C-shaped bracket 44. The bracket 44 has a central section 46 with an opening 48 to receive screw 40 and a pair of outwardly extending flanges 50. The flanges have aligned openings that receive a pin 52. Secured about the pin 52 is a strap 54 from the sail 12.

Alternatively, secured between the head 42 of screw 40 and the swivel base 36 is a spacer 56 and cap 58. The spacer 56 and cap 58 have central openings 38 that receive screw 40. The spacer 56 and/or the cap 58 have side openings 60 that receive the ends of ring 62. Secured to the ring 62 are straps 54 from sail 12. Preferably, the slugs 16 are positioned about 24 inches apart.

Removably secured to the sail 12 between the slugs 16 are a plurality of flakers 64. The flakers are comprised of a pair of leaves 66 having a first end 68, a flat longitudinal section 70, and an upwardly and outwardly extending bracket 72 at the second end 74. The brackets 72 have openings that align to receive a torsion spring 76 and an axle 77 that permits the leaves 66 to be hingedly connected to one another. The torsion spring 76 has a knob 78 for adjusting the tension of the spring to hold the leaves 66 in a generally closed position and a spacer 79 is positioned about the axle below the spring 76. On the opposite side of knob 78 is a locking knob 80 that releasably secures a locking plate 82 over the end of spring 76 so that the leaves will not open to more than 186° and cause a jam.

The first ends 68, which preferably are made of stainless steel, fit within a Teflon sleeve 84 such that the flaker 64 slides and floats within sleeve 84. Also, a small strap 86 extends around spring 76 and terminates at a connecting end 88 which has a snap 90.

The flaker 64, fitted within sleeve 84 is preferably secured to the sail 12 with a pocket 92 sewn to the sail 12. The pocket 92 is comprised of an elongated strip of material 94 wherein the ends are folded over to form pockets. At the first end 96, the end is sewn along its length to form a first pocket 98 that receives one end of sleeve 84. A second end 99 has a plurality of snaps 100 that form a second pocket 102. At least one of the snaps 100 is aligned with and receives snap 90. Preferably the flakers 64 are centered between the slugs 16 and are staggered from one side of the sail 12 to the other.

In operation, when the sail 12 is lowered, the torsion spring 76 will force the flakers 64 toward a closed position while the swivel on slugs 16 will act as a pivot point between two flakers 64. As a result, the sail 12 lays over horizontally between the flakers. As the slugs 16 move down groove 18 in mast 14, the sail 12 is lowered in an "S" shaped fashion until the sail lays on top of the boom and is ready for storage.

The first time the sail 12 is lowered, the folds of the sail 12 are laid on the boom carefully making sure that the loops or folds are on the same side at the back as they are on the front and that the middle of the loops are generally centered on the boom. Where the edge of the sail 12 crosses the center of the boom, mark a "1" on the other side of the sail edge. For each successive point where the sail's edge crosses the center of the boom, mark "2", "3", and so on. The next time the sail 12 is lowered, the numbers are matched to insure the sail 12 is flaked in a seaman type fashion.

In an alternative embodiment, in order to fit a variety of mast 14 shapes and sizes and to avoid resistance and tipping, the mounting plates 20 of the sail slug 16 have a pair of ears 102 that extend outwardly from the outer edge 26 of mounting plates 20. The ears have elongated slots 104 with each slidably receiving a roller 30. The rollers 30 are positioned on opposite sides of mounting plates 20. Preferably, all rollers are connected with a rivet 34.

In operation, rollers 30 on the inner edge 24 are positioned within groove 18 of mast 14. The mounting plates 20 extend out of groove 18 and the ring 62 of the sail slug 16 is connected to strap 54 of mast 14. The rollers 30 in slots 104 of ears 102 engage the outer surface of the mast 14. By sliding within slots 104, the rollers 30 prevent sail slug 16 from sticking within groove 18 when raising and lowering the mast 14.

What is claimed is:

1. A sail assembly, comprising:

a slug having a plurality of rollers aligned along an inner edge of a pair of mounting plates;

a pair of rollers attached to ears of the mounting plates; and a mast having a groove that receives the plurality of rollers aligned along an inner edge.

2. The sail assembly of claim 1 wherein the ears have slots that slidably engage the pair of rollers.

3. The sail assembly of claim 1 wherein the plurality of rollers and the pair of rollers are connected to the mounting plates with rivets.

* * * * *